US010301570B2

(12) United States Patent
Ishikawa et al.

(10) Patent No.: US 10,301,570 B2
(45) Date of Patent: May 28, 2019

(54) LUBRICATING OIL COMPOSITION FOR INTERNAL COMBUSTION ENGINE

(71) Applicant: IDEMITSU KOSAN CO., LTD., Chiyoda-ku (JP)

(72) Inventors: Motoharu Ishikawa, Chiba (JP); Tatsuya Kusumoto, Chiba (JP); Shinji Suzuki, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 15/318,369

(22) PCT Filed: Mar. 31, 2016

(86) PCT No.: PCT/JP2016/060628
§ 371 (c)(1),
(2) Date: Dec. 13, 2016

(87) PCT Pub. No.: WO2016/159216
PCT Pub. Date: Oct. 6, 2016

(65) Prior Publication Data

US 2017/0121627 A1 May 4, 2017

(30) Foreign Application Priority Data

Mar. 31, 2015 (JP) ..... 2015-074386

(51) Int. Cl.

| | |
|---|---|
| ***C10M 129/50*** | (2006.01) |
| ***C10M 141/08*** | (2006.01) |
| ***C10M 141/12*** | (2006.01) |
| ***C10M 163/00*** | (2006.01) |
| ***C10M 169/04*** | (2006.01) |

(52) U.S. Cl.

CPC ..... *C10M 141/08* (2013.01); *C10M 129/50* (2013.01); *C10M 141/12* (2013.01); *C10M 163/00* (2013.01); *C10M 169/04* (2013.01); *C10M 2203/003* (2013.01); *C10M 2203/024* (2013.01); *C10M 2203/1006* (2013.01); *C10M 2207/023* (2013.01); *C10M 2207/026* (2013.01); *C10M 2207/262* (2013.01); *C10M 2207/289* (2013.01); *C10M 2209/084* (2013.01); *C10M 2215/04* (2013.01); *C10M 2215/064* (2013.01); *C10M 2215/28* (2013.01); *C10M 2219/046* (2013.01); *C10M 2219/068* (2013.01); *C10M 2223/045* (2013.01); *C10M 2227/066* (2013.01); *C10N 2210/02* (2013.01); *C10N 2210/06* (2013.01); *C10N 2220/021* (2013.01); *C10N 2220/082* (2013.01); *C10N 2230/02* (2013.01); *C10N 2230/04* (2013.01); *C10N 2230/06* (2013.01); *C10N 2230/10* (2013.01); *C10N 2230/38* (2013.01); *C10N 2230/43* (2013.01); *C10N 2230/45* (2013.01); *C10N 2230/50* (2013.01); *C10N 2230/52* (2013.01); *C10N 2230/66* (2013.01); *C10N 2240/10* (2013.01); *C10N 2240/102* (2013.01); *C10N 2240/104* (2013.01)

(58) Field of Classification Search

CPC ..... C10M 2207/026; C10M 2207/262; C10M 2215/064; C10M 2219/068
USPC ..... 508/365, 460
See application file for complete search history.

(56) References Cited

U.S. PATENT DOCUMENTS

| | | | | |
|---|---|---|---|---|
| 5,534,168 | A | 7/1996 | Cleverley et al. | |
| 6,147,035 | A * | 11/2000 | Sougawa | C10M 163/00 508/192 |
| 8,470,749 | B2 * | 6/2013 | Seddon | C10M 159/20 241/170 |
| 2002/0019320 | A1 | 2/2002 | Nakazato et al. | |
| 2003/0134756 | A1 | 7/2003 | Carrick et al. | |
| 2005/0043191 | A1 | 2/2005 | Farng et al. | |
| 2011/0003723 | A1 | 1/2011 | Teshima et al. | |
| 2012/0118258 | A1 | 5/2012 | Takeuchi et al. | |
| 2015/0005208 | A1 | 1/2015 | Yaguchi et al. | |
| 2015/0322368 | A1 | 11/2015 | Patel et al. | |
| 2016/0348027 | A1 | 12/2016 | Utaka | |
| 2018/0072961 | A1 | 3/2018 | Utaka et al. | |

FOREIGN PATENT DOCUMENTS

| | | | |
|---|---|---|---|
| EP | 0 725 129 | A2 | 8/1996 |
| EP | 0 860 495 | A2 | 8/1998 |
| JP | 2000-256690 | A | 9/2000 |
| JP | 2002-53888 | A | 2/2002 |
| JP | 2011-195774 | A | 10/2011 |
| JP | 2012-57045 | A | 3/2012 |
| WO | 2005/021693 | A1 | 3/2005 |
| WO | 2009/101933 | A1 | 8/2009 |
| WO | 2013/118363 | A1 | 8/2013 |
| WO | WO 2015/111746 | A1 | 7/2015 |
| WO | 2015/151769 | A1 | 10/2015 |
| WO | WO 2016/152993 | A1 | 9/2016 |

OTHER PUBLICATIONS

International Search Report dated Jun. 28, 2016 in PCT/JP2016/060628 filed Mar. 31, 2016.
Extended European Search Report dated Nov. 8, 2018 in Patent Application No. 16773096.9, 8 pages.

* cited by examiner

*Primary Examiner* — Vishal V Vasisth
(74) *Attorney, Agent, or Firm* — Oblon, McClelland, Maier & Neustadt, L.L.P.

(57) ABSTRACT

Provided are a lubricating oil composition for internal combustion engine, containing a lubricating base oil containing a mineral oil and/or a synthetic oil, (A) an overbased calcium salicylate, (B) an overbased magnesium detergent, (C) a binuclear and/or trinuclear organic molybdenum compound, (D) a phenol-based antioxidant, and (E) an amine-based antioxidant, wherein the component (C), the component (D), and the component (E) are contained in specified contents on the basis of the whole amount of the lubricating oil composition; a method for producing the lubricating oil composition for internal combustion engine; and a lubrication method including using the lubricating oil composition for internal combustion engine.

21 Claims, No Drawings

LUBRICATING OIL COMPOSITION FOR INTERNAL COMBUSTION ENGINE

This application is a 371 of PCT/JP2016/060628, filed Mar. 31, 2016.

TECHNICAL FIELD

The present invention relates to a lubricating oil composition for internal combustion engine.

BACKGROUND ART

In recent years, in order to improve the fuel consumption, the development of a direct injection gasoline engine (downsizing engine) mounted with a supercharger, such as a turbo charger, etc., is being advanced at a quick pace. Because of direct injection, a soot (e.g., a particulate matter (PM) contained in an exhaust gas, etc.) is generated even in a gasoline engine likewise a diesel engine. For that reason, it is necessary to install a post-processing device of exhaust gas (in particular, a particulate filter or an exhaust gas cleaning device). However, it is known that a lubricating oil composition affects such a post-processing device of exhaust gas.

In the case of using a lubricating oil composition containing a metal-based detergent, there is a concern that in view of the matter that a metal component derived from the metal-based detergent deposits in the inside of a filter in the post-processing device of exhaust gas, clogging of the filter or worsening of catalytic activity is caused. For that reason, reduction of the ash content of the lubricating oil composition is demanded.

For example, PTL 1 discloses a lubricating oil composition for internal combustion engine, in which a calcium detergent, such as calcium phenate, etc., is blended such that a sulfuric acid ash content is 0.7 weight % or less.

CITATION LIST

Patent Literature

PTL 1: JP 2000-256690 A

SUMMARY OF INVENTION

Technical Problem

As described above, reduction of the ash content of the lubricating oil composition is demanded. However, the quantity reduction of the metal-based detergent that is an additive containing a metal component decreases a base number, leading to worsening of high-temperature detergency. As a result, the generation of caulking (a phenomenon in which the lubricating oil composition is carbonized and degenerated to form a carbide) is caused.

In view of the aforementioned circumstances, the present invention has been made. A problem of the present invention is to provide a lubricating oil composition for internal combustion engine, having a low sulfuric acid ash content, capable of suppressing a decrease of the base number at the time of contamination of NOx gas, and having excellent caulking resistance as well as excellent friction-reducing effect of an engine member.

Solution to Problem

The present inventors made extensive and intensive investigations. As a result, it has been found that the aforementioned problem can be solved by blending a lubricating base oil with two kinds of specified metal-based detergents, blending a specified amount of a specified friction modifier, and blending specified amounts of two kinds of specified antioxidants. The present invention has been accomplished on the basis of such finding. Specifically, according to the present invention, the following [1] to [4] are provided.

[1] A lubricating oil composition for internal combustion engine, comprising a lubricating base oil containing a mineral oil and/or a synthetic oil, (A) an overbased calcium salicylate, (B) an overbased magnesium detergent, (C) a binuclear and/or trinuclear organic molybdenum compound, (D) a phenol-based antioxidant, and (E) an amine-based antioxidant, wherein the component (B) has a median diameter of 100 nm or more on the basis of scattering intensity as measured by photon correlation spectroscopy;

the molybdenum content derived from the component (C) is 200 to 1,000 ppm by mass on the basis of the whole amount of the lubricating oil composition;

the content of the component (D) is 0.40 mass % or more on the basis of the whole amount of the lubricating oil composition; and the content of the component (E) is 0.60 mass % or more on the basis of the whole amount of the lubricating oil composition.

[2] A method for producing a lubricating oil composition for internal combustion engine, comprising blending a lubricating base oil containing a mineral oil and/or a synthetic oil, (A) an overbased calcium salicylate, (B) an overbased magnesium detergent which has a median diameter of 100 nm or more as measured by photon correlation spectroscopy, (C) a binuclear and/or trinuclear organic molybdenum compound, (D) a phenol-based antioxidant, and (E) an amine-based antioxidant, such that the molybdenum content derived from the component (C) is 200 to 1,000 ppm by mass on the basis of the whole amount of the lubricating oil composition;

the content of the component (D) is 0.40 mass % or more on the basis of the whole amount of the lubricating oil composition; and the content of the component (E) is 0.60 mass % or more on the basis of the whole amount of the lubricating oil composition.

[3] A lubrication method including using the lubricating oil composition for internal combustion engine according to the above [1].

[4] A lubrication method including using a lubricating oil composition for internal combustion engine obtained by the production method according to the above [2].

Advantageous Effects of Invention

In accordance with the present invention, it is possible to provide a lubricating oil composition for internal combustion engine, having a low sulfuric acid ash content, capable of suppressing a decrease of the base number at the time of contamination of NOx gas, and having excellent caulking resistance as well as excellent friction-reducing effect of an engine member.

DESCRIPTION OF EMBODIMENTS

Suitable embodiments of the present invention are hereunder described in detail.

[Lubricating Oil Composition for Internal Combustion Engine]

The lubricating oil composition for internal combustion engine (hereinafter sometimes referred to simply as "lubricating oil composition") as an embodiment of the present invention is a lubricating oil composition for internal combustion engine, containing a lubricating base oil composed of a mineral oil and/or a synthetic oil, (A) an overbased calcium salicylate, (B) an overbased magnesium detergent, (C) a binuclear and/or trinuclear organic molybdenum compound, (D) a phenol-based antioxidant, and (E) an amine-based antioxidant, wherein the component (B) has a median diameter of 100 nm or more on the basis of scattering intensity as measured by photon correlation spectroscopy, and the molybdenum content derived from the component (C) is 200 to 1,000 ppm by mass on the basis of the whole amount of the lubricating oil composition; the content of the component (D) is 0.40 mass % or more on the basis of the whole amount of the lubricating oil composition; and the content of the component (E) is 0.60 mass % or more on the basis of the whole amount of the lubricating oil composition.

As for the lubricating oil composition, it is preferred that a sulfuric acid ash content is 1.00 mass % or less on the basis of the whole amount of the lubricating oil composition. In view of the fact that a value of the sulfuric acid ash content falls within the foregoing range, it is possible to obtain a lubricating oil composition that is less in adverse influence (for example, clogging of a filter or degradation of an exhaust gas cleaning device) against a particulate filter installed in an engine having a post-processing device of exhaust gas installed therein, for example, a downsizing engine, etc. From such a viewpoint, the sulfuric acid ash content is more preferably 0.90 mass % or less, still more preferably 0.85 mass % or less, and yet still more preferably 0.80 mass % or less. The sulfuric acid ash content is preferably 0.001 mass % or more, and more preferably 0.01 mass % or more.

The value of the sulfuric acid ash content is a value as calculated by the method described in the Examples as mentioned later.

By regulating the amount of metal-containing additives among the component (A), the component (B), and the component (C) as mentioned later and other components, the amount of the sulfuric acid ash content of the lubricating oil composition can be regulated. As for each of the component (A), the component (B), and the component (C) as mentioned later, in general, the effect corresponding to the addition amount thereof is obtained within a range or preferred range as mentioned later. However, it is preferred to regulate an upper limit value thereof so as to satisfy the range of the sulfuric acid ash content of the lubricating oil composition. According to this, by minimizing the metal content, namely the sulfuric acid ash content, of the lubricating oil composition for internal combustion engine, the degradation of an exhaust gas cleaning device of automobile can be more effectively prevented from occurring.

<Lubricating Base Oil>

The lubricating base oil that is used in the present invention is not particularly limited, and an arbitrary mineral oil or synthetic oil conventionally used as a base oil of lubricating oil can be appropriately selected and used.

Examples of the mineral oil include a mineral oil refined by subjecting a lubricating oil distillate that is obtained by distilling under reduced pressure an atmospheric residue given by atmospheric distillation of crude oil, to one or more treatments selected from solvent deasphalting, solvent extraction, hydro-cracking, solvent dewaxing, catalytic dewaxing, and hydrorefining, and the like; a base oil produced by isomerizing a wax or GTL WAX (gas-to-liquid wax); and the like. Of those, a mineral oil treated by hydrorefining and a base oil produced by isomerizing GTL WAX are preferred. These base oils readily make a % $C_p$ and a viscosity index as mentioned later good.

Examples of the synthetic oil include poly-α-olefins, such as polybutene, an α-olefin homopolymer or copolymer (e.g., an ethylene-α-olefin copolymer), etc.; various esters, such as a polyol ester, a dibasic acid ester, a phosphate ester, etc.; various ethers, such as a polyphenyl ether, etc.; polyglycols; alkylbenzenes; alkylnaphthalenes; and the like. Of those synthetic oils, in particular, poly-α-olefins and esters are preferred, and those obtained by combining two kinds thereof are also suitably used as the synthetic oil.

In the embodiment of the present invention, the aforementioned mineral oils may be used singly or may be used in combination of two or more thereof as the lubricating base oil. In addition, the aforementioned synthetic oils may be used singly or may be used in combination of two or more thereof. Furthermore, one or more of the mineral oils and one or more kinds of the synthetic oils may be used in combination.

The lubricating base oil is contained in an amount of typically 65 mass % or more, preferably 70 to 97 mass %, and more preferably 75 to 95 mass % relative to the whole amount of the lubricating oil composition.

Although the lubricating base oil is not particularly limited with respect to the viscosity, a kinematic viscosity thereof at 100° C. is in the range of preferably from 2 to 30 $mm^2/s$, more preferably from 3 to 15 $mm^2/s$, and still more preferably from 4 to 10 $mm^2/s$.

When the kinematic viscosity at 100° C. of the base oil is 2 $mm^2/s$ or more, an evaporation loss is small, and when it is 30 $mm^2/s$ or less, a power loss to be caused due to viscous resistance is suppressed, so that a fuel consumption improving effect is obtained. The value of the kinematic viscosity at 100° C. is one as measured by the method described in the Examples as mentioned later.

Although a kinematic viscosity at 40° C. is not particularly limited, it is in the range of preferably from 5 to 65 $mm^2/s$, more preferably from 8 to 40 $mm^2/s$, and still more preferably from 10 to 25 $mm^2/s$.

A viscosity index of the lubricating base oil is preferably 100 or more, more preferably 110 or more, still more preferably 120 or more, and yet still more preferably 130 or more. The base oil having a viscosity index of 100 or more is small in a change in viscosity due to a change in temperature.

When the viscosity index of the lubricating base oil falls within the foregoing range, it is easy to make the viscosity characteristics of the lubricating oil composition good. This viscosity index is an index as measured by the method described in the Examples as mentioned later.

As the lubricating base oil, one having an aromatic content (% $C_A$) by ring analysis of 3.0 or less and a content of sulfur component of 10 ppm by mass or less is preferably used. The term "% $C_A$ by ring analysis" refers to a proportion (percentage) of aromatic components calculated by the ring analysis n-d-M method. The sulfur content is a value as measured in conformity with JIS K2541.

The base oil having a % $C_A$ of 3.0 or less and a sulfur content of 10 ppm by mass or less has good oxidation stability and is able to provide a lubricating oil composition capable of suppressing an increase of acid number or the generation of sludge. The % $C_A$ is more preferably 1.0 or less, and still more preferably 0.5 or less, and the sulfur content is more preferably 5 ppm by mass or less.

The lubricating base oil has a paraffin content (% $C_p$) as measured by ring analysis of preferably 75 or more, more preferably 80 or more, and still more preferably 85 or more. When the % $C_p$ is 75 or more, the oxidation stability of the base oil becomes good. Here, the term "% $C_p$ by ring analysis" refers to a proportion (percentage) of paraffin components calculated by the ring analysis n-d-M method.

A NOACK value of the lubricating base oil is preferably 15.0 mass % or less, and more preferably 14.0 mass % or less.

<(A) Overbased Calcium Salicylate>

The lubricating oil composition for internal combustion engine that is the embodiment of the present invention contains (A) an overbased calcium salicylate (hereinafter also referred to simply as "component (A)"). In view of the fact that the component (A) is contained, a decrease of the base number at the time of contamination of NOx gas can be suppressed, and excellent caulking resistance is obtained. In addition, in the view of the fact that the component (A) is contained, a fuel consumption reducing performance can be improved.

The base number (perchloric acid method) of the component (A) that is used in the present invention is preferably 150 mgKOH/g or more, and more preferably 170 mgKOH/g or more, and preferably 450 mgKOH/g or less, and more preferably 400 mgKOH/g or less. When the base number (perchloric acid method) is 150 mgKOH/g or more, the caulking resistance is thoroughly exhibited, and the content of the component (A) can be decreased. When the base number is 450 mgKOH/g or less, the low-temperature properties of the lubricating oil composition become good.

The alkyl group which an alkylsalicylic acid group that is a soap group constituting the component (A) has is preferably one having 4 to 30 carbon atoms, more preferably a linear or branched alkyl group having 6 to 24 carbon atoms, and still more preferably a linear alkyl group having 10 to 24 carbon atoms.

The component (A) has plural alkyl groups in the same molecule, and therefore, it includes one having alkyl groups having the same number of carbon atoms and one having alkyl groups having a different number of carbon atoms from each other. The component (A) may be used singly or may be used in combination of two or more thereof. In the case where a combination of two or more kinds is used as the component (A), or in the case where even in the case of using the component (A) singly, and the component (A) has plural alkyl groups in the same molecule, the number of carbon atoms of the alkyl group constituting the component (A) and occupying in the largest number therein (hereinafter also referred to as "major number of carbon atoms of the alkyl group which the component (A) has") is preferably 10 to 24. In the view of the fact that the major number of carbon atoms of the alkyl group which the component (A) has falls within the foregoing range, good oil solubility is obtained.

The term "oil solubility" as used in the present specification does not always express that a compound or additive is fully soluble in an oil but means that it is dissolved or dispersed in an oil at the time of use, transportation, or storage.

Examples of the component (A) include ones obtained by using a calcium salt of alkylsalicylic acid (neutral calcium salicylate) that is obtained by allowing an alkylsalicylic acid, such as a dialkylsalicylic acid, etc., to react directly with a base, such as an oxide or hydroxide of calcium, etc., or by once converting it into an alkali metal salt, such as a sodium salt, a potassium salt, etc., and then substituting the alkali metal salt with calcium, and allowing the neutral calcium salicylate to react with a hydroxide of calcium or the like in the presence of a carbon dioxide gas or boric acid or a boric acid salt.

The calcium content derived from the component (A) is preferably 2,000 ppm by mass or less on the basis of the whole amount of the lubricating oil composition for internal combustion engine. In view of the fact that the calcium content falls within this range, nevertheless the low sulfuric acid ash content, a decrease of the base number at the time of contamination of NOx gas can be suppressed, and excellent caulking resistance is obtained. From the foregoing viewpoint, the calcium content derived from the component (A) is more preferably 1,800 ppm by mass or less, and still more preferably 1,500 ppm by mass or less on the basis of the whole amount of the lubricating oil composition for internal combustion engine. The calcium content is preferably 500 ppm by mass or more, more preferably 800 ppm by mass or more, and still more preferably 1,000 ppm by mass or more on the basis of the whole amount of the lubricating oil composition for internal combustion engine.

The component (A) may be used singly, or a combination of two or more kinds that are different in the aforementioned properties or structure may also be used. Suitable ranges of the base number (perchloric acid method), the number of carbon atoms of the alkyl group of soap group, and the calcium content are also the same as total values in the case of combining two or more kinds.

<(B) Overbased Magnesium Detergent>

As the overbased magnesium detergent (B) (hereinafter also referred to simply as "component (B)") that is used in the present invention, an overbased magnesium detergent that is used for a lubricating oil can be used, and examples thereof include one or more overbased magnesium detergents selected from overbased magnesium sulfonate, overbased magnesium phenate, and overbased magnesium salicylate.

By using the component (B) in combination with the component (A), with respect to the lubricating oil composition, the metal content can be decreased while keeping a fixed base number. For that reason, even in a low sulfuric acid ash content, it is possible to obtain a lubricating oil composition for internal combustion engine, in which a decrease of the base number at the time of contamination of NOx gas is suppressed, and excellent caulking resistance is revealed.

The alkyl group which a soap group constituting the component (B), such as a sulfonic acid group, a phenol group, a salicylic acid group, etc., has is preferably one having 4 to 30 carbon atoms, more preferably a linear or branched alkyl group having 6 to 24 carbon atoms, and still more preferably a linear or branched alkyl group having 10 to 24 carbon atoms.

The component (B) has plural alkyl groups in the same molecule, and therefore, it includes one having alkyl groups having the same number of carbon atoms and one having alkyl groups having a different number of carbon atoms from each other. The component (B) may be used singly or may be used in combination of two or more thereof. In the case where a combination of two or more kinds is used as the component (B), or in the case where even in the case of using the component (B) singly, and the component (B) has plural alkyl groups in the same molecule, the number of carbon atoms of the alkyl group constituting the component (B) and occupying in the largest number therein (hereinafter also referred to as "major number of carbon atoms of the alkyl group which the component (B) has") is preferably 10 to 24. In the view of the fact that the major number of carbon atoms of the alkyl group which the component (B) has falls within the foregoing range, good oil solubility is obtained.

Although such an alkyl group may be either linear or branched, it is preferably a linear alkyl group.

The alkyl group may be a primary alkyl group, a secondary alkyl group, or a tertiary alkyl group.

Examples of the overbased magnesium sulfonate include ones obtained by using a magnesium salt (neutral magnesium sulfonate) that is obtained by allowing an alkyl aromatic sulfonic acid obtained through sulfonation of an alkyl aromatic compound having a molecular weight of preferably 300 to 1,500, and more preferably 400 to 700 to react directly with a base, such as an oxide or hydroxide of magnesium, etc., or by once converting it into an alkali metal salt, such as a sodium salt, a potassium salt, etc., and then substituting the alkali metal salt with magnesium, and allowing the neutral magnesium sulfonate to react with an excess of magnesium oxide and/or magnesium hydroxide in the presence of a carbon dioxide gas or boric acid or a boric acid salt; ones obtained by mixing a magnesium supply source, such as magnesium oxide, magnesium hydroxide, a magnesium alkoxide, etc., in a solvent, such as a hydrocarbon solvent, an alcohol, etc., then mixing the aforementioned alkyl aromatic sulfonic acid, and further mixing a promoter for promoting carbonation, such as an organic monocarboxylic acid, a hydrocarbon-substituted succinic anhydride, or a derivative thereof, etc., followed by introducing carbon dioxide into the resulting mixture; and the like.

Examples of the overbased magnesium phenate include ones obtained by using a magnesium salt (neutral magnesium phenate) that is obtained by allowing an alkylphenol, an alkylphenol sulfide, or a Mannich reaction product of alkylphenol to react directly with a base, such as an oxide or hydroxide of magnesium, etc., or by once converting it into an alkali metal salt, such as a sodium salt, a potassium salt, etc., and then substituting the alkali metal salt with magnesium, and allowing the neutral magnesium phenate to react with an excess of magnesium oxide and/or magnesium hydroxide in the presence of a carbon dioxide gas or boric acid or a boric acid salt; ones obtained by mixing a magnesium supply source, such as magnesium oxide, magnesium hydroxide, a magnesium alkoxide, etc., in a solvent, such as a hydrocarbon solvent, an alcohol, etc., then mixing the aforementioned alkylphenol, alkylphenol sulfide, or Mannich reaction product of alkylphenol, and further mixing a promoter for promoting carbonation, such as an organic monocarboxylic acid, a hydrocarbon-substituted succinic anhydride, or a derivative thereof, etc., followed by introducing carbon dioxide into the resulting mixture; and the like.

Examples of the overbased magnesium salicylate include ones obtained by using a magnesium salt (neutral magnesium salicylate) that is obtained by allowing an alkyl salicylic acid, such as a dialkyl salicylic acid, etc., to react directly with a base, such as an oxide or hydroxide of magnesium, etc., or by once converting it into an alkali metal salt, such as a sodium salt, a potassium salt, etc., and then substituting the alkali metal salt with magnesium, and allowing the neutral magnesium salicylate to react with an excess of magnesium oxide and/or magnesium hydroxide in the presence of a carbon dioxide gas or boric acid or a boric acid salt; ones obtained by mixing a magnesium supply source, such as magnesium oxide, magnesium hydroxide, a magnesium alkoxide, etc., in a solvent, such as a hydrocarbon solvent, an alcohol, etc., then mixing the aforementioned alkyl salicylic acid, and further mixing a promoter for promoting carbonation, such as an organic monocarboxylic acid, a hydrocarbon-substituted succinic anhydride, or a derivative thereof, etc., followed by introducing carbon dioxide into the resulting mixture; and the like.

The component (B) that is used in the present invention has a median diameter (D(50)) of 100 nm or more on the basis of scattering intensity as measured by photon correlation spectroscopy.

In view of the fact that the median diameter is 100 nm or more, excellent mixing stability is revealed. The median diameter is preferably 150 nm or more. Although an upper limit value thereof is not particularly limited, from the viewpoint of stability of the lubricating oil composition, it is preferably 400 nm or less, and more preferably 300 nm or less.

The median diameter (D(50)) refers to a particle diameter at the time when a proportion occupying 100% of the whole particles is 50% (relative amount of particles: 50%) in the case where in the particle diameter distribution obtained by photon correlation spectroscopy, deposition is made in the order from those having smaller particle diameters. Specifically, the median diameter (D(50)) is a value as measured by the method described in the Examples as mentioned later.

From the viewpoint of mixing stability, the component (B) that is used in the present invention, a 90% particle diameter (D(90)) as measured by photon correlation spectroscopy is preferably 200 nm or more, more preferably 300 nm or more, and still more preferably 350 nm or more. Although an upper limit value thereof is not particularly limited, it is preferably 500 nm or less.

The 90% particle diameter (D(90)) refers to a particle diameter at the time when a proportion occupying 100% of the whole particles is 90% (relative amount of particles: 90%) in the case where in the particle diameter distribution obtained by photon correlation spectroscopy, deposition is made in the order from those having smaller particle diameters. Specifically, the 90% particle diameter (D(90)) is a value as measured by the method described in the Examples as mentioned later.

In the component (B) that is used in the present invention, from the viewpoint of mixing stability, in a dispersed particle diameter distribution as measured by photon correlation spectroscopy, a proportion of particles in which a particle diameter occupying 100% of the whole is 200 nm or more is preferably 20% or more, more preferably 30% or more, and still more preferably 40% or more. In addition, from the same viewpoint, in the foregoing dispersed particle diameter distribution, a proportion of particles in which a particle diameter occupying 100% of the whole is 300 nm or more is preferably 10% or more, more preferably 15% or more, and still more preferably 20% or more.

From the mixing stability, in the aforementioned dispersed particle diameter distribution, a proportion of particles in which a particle diameter occupying 100% of the whole is 400 nm or more is preferably 30% or less, and more preferably 15% or less. In addition, from the same viewpoint, in the aforementioned dispersed particle diameter distribution, a proportion of particles in which a particle diameter occupying 100% of the whole is 500 nm or more is preferably 20% or less, and more preferably 10% or less.

Meanwhile, from the viewpoint of mixing stability, in the aforementioned dispersed particle diameter distribution, a proportion of particles in which a particle diameter occupying 100% of the whole is less than 100 nm is preferably 60% or less, more preferably 50% or less, and still more preferably 45% or less.

Specifically, the dispersed particle diameter distribution is measured by the method described in the Examples as mentioned later.

The magnesium content derived from the component (B) is preferably 1,000 ppm by mass or less on the basis of the whole amount of the lubricating oil composition for internal combustion engine. In view of the fact that the magnesium content falls within this range, nevertheless the low sulfuric acid ash content, a decrease of the base number at the time of contamination of NOx gas can be suppressed, and excellent caulking resistance is obtained. From the foregoing viewpoint, the magnesium content is more preferably 800 ppm by mass or less, still more preferably 600 ppm by mass or less, and yet still more preferably 550 ppm by mass or less. The magnesium content is preferably 200 ppm by mass or more, more preferably 300 ppm by mass or more, and still more preferably 400 ppm by mass or more.

<(C) Binuclear and/or Trinuclear Organic Molybdenum Compound>

The lubricating oil composition for internal combustion engine that is the embodiment of the present invention contains (C) a binuclear and/or trinuclear organic molybdenum compound (hereinafter also referred to simply as "component (C)"). In view of the fact that the component (C) is contained, a good friction-reducing effect is brought.

In the embodiment of the present invention, the binuclear organic molybdenum compound is one represented by the following general formula (I).

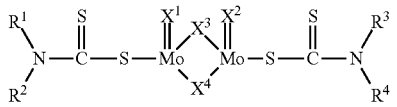

(I)

In the general formula (I), each of $R^1$ to $R^4$ represents a hydrocarbon group having 4 to 22 carbon atoms, and $R^1$ to $R^4$ may be the same as or different from each other. When the number of carbon atoms is 3 or less, the binuclear organic molybdenum compound has poor oil solubility. When the number of carbon atoms is 23 or more, the binuclear organic molybdenum compound has a high melting point, so that it is difficult to handle and has a poor friction-reducing effect. From these viewpoints, the number of carbon atoms is preferably 4 to 18, and more preferably 8 to 13. Examples of the hydrocarbon group include an alkyl group, an alkenyl group, an alkylaryl group, a cycloalkyl group, and a cycloalkenyl group. A branched or linear alkyl group or a branched or linear alkenyl group is preferred, and a branched or linear alkyl group is more preferred. Examples of the branched or linear alkyl group having 8 to 13 carbon atoms include an n-octyl group, a 2-ethylhexyl group, an isononyl group, an n-decyl group, an isodecyl group, a dodecyl group, a tridecyl group, an isotridecyl group, and the like. From the viewpoints of solubility in the lubricating base oil, storage stability, and friction-reducing effect, it is preferred that $R^1$ and $R^2$ are the same alkyl group, $R^3$ and $R^4$ are the same alkyl group, and the alkyl groups of $R^1$ and $R^2$ and the alkyl groups of $R^3$ and $R^4$ are different from each other.

In the general formula (I), each of $X^1$ to $X^4$ represents a sulfur atom or an oxygen atom, and $X^1$ to $X^4$ may be the same as or different from each other. A ratio between the sulfur atom and the oxygen atom is preferably 1/3 to 3/1, and more preferably 1.5/2.5 to 3/1 in terms of (sulfur atom)/(oxygen atom). When the ratio falls within the foregoing range, good performances are obtained from the standpoints of corrosion resistance and solubility in the base oil. All of $X^1$ to $X^4$ may be a sulfur atom or an oxygen atom, and are preferably an oxygen atom.

The binuclear organic molybdenum compound is preferably binuclear molybdenum dithiocarbamate.

The trinuclear organic molybdenum compound is one represented by the following general formula (II).

$$Mo_3S_kL_nQ_z \quad \text{(II)}$$

In the general formula (II), each of Ls independently represents a selected ligand having an organic group containing a carbon atom; n is 1 to 4; k varies between 4 and 7; each of Qs is independently selected from the group consisting of neutral electron donating compounds, such as water, an amine, an alcohol, an ether, and the like; and z is in the range of from 0 to 5 and includes non-stoichiometric values. It is preferred that at least 21 carbon atoms, such as at least 25 carbon atoms, at least 30 carbon atoms, or at least 35 carbon atoms, are present in total in all the organic groups of the ligands in order to render the trinuclear organic molybdenum compound oil-soluble.

The ligand is, for example, selected from the group consisting of the following ligands and mixtures thereof.

[Chem. 2]

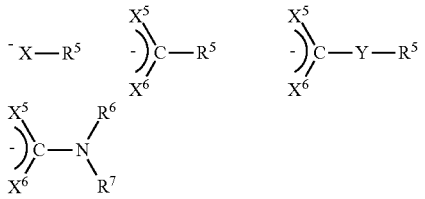

In these general formulae, each of X, $X^5$, $X^6$, and Y is independently selected from the group consisting of oxygen and sulfur; and each of $R^5$, $R^6$, and $R^7$ is independently selected from hydrogen and an organic group and may be the same as or different from each other.

Preferably, the aforementioned organic group is a hydrocarbyl group, such as an alkyl group, an aryl group, a substituted aryl group, an ether group, etc. (in which the carbon atom bonded to the residue of the ligand is, for example, primary or secondary). More preferably, each ligand has the same hydrocarbyl group.

The term "hydrocarbyl" refers to a substituent having a carbon atom directly bonded to the residue of the ligand, and is predominantly hydrocarbyl in properties within the scope of the present invention. Such a substituent includes the following.

1. Hydrocarbon substituents, that is, aliphatic substituents (for example, an alkyl group or an alkenyl group), alicyclic substituents (for example, a cycloalkyl group or a cycloalkenyl group), aromatic groups, aliphatic groups, or alicyclic group-substituted aromatic nuclei, and the like; and cyclic groups in which the ring is completed through another portion of the ligand (that is, arbitrary two indicated substituents may together form an alicyclic group).

2. Substituted hydrocarbon substituents, that is, those containing a non-hydrocarbon group that does not alter the predominantly hydrocarbyl properties of the substituent within the scope of the present invention. Examples of the non-hydrocarbon group include a halogen group, such as chloro, fluoro, etc., an amino group, an alkoxy group, a mercapto group, an alkylmercapto group, a nitro group, a nitroso group, a sulfoxy group, and the like.

It is suitable that the organic groups of the ligands have a sufficient number of carbon atoms to impart oil solubility to the component (C). For example, the number of carbon atoms in each group typically ranges between 1 and about 100, preferably between 1 and 30, and more preferably between 4 and 20. Preferred examples of the ligand include an alkylxanthate salt, a carboxylate salt, a dialkyldithiocarbamate salt, and a mixture thereof. A dialkyldithiocarbamate salt is most preferred. The formation of the component (C) requires selection of a ligand having an appropriate charge so as to balance the core's charge.

Compounds having a structure of the general formula: $Mo_3S_kL_nQ_z$ have cationic cores surrounded by anionic ligands, and the cationic cores are represented by structures having net charges of +4 as shown below.

[Chem. 3]

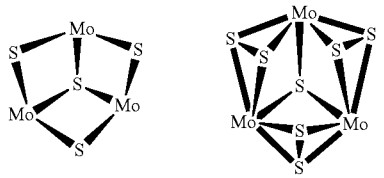

Thus, in order to solubilize these cores, the total charge among all the ligands must be −4. Four monoanionic ligands are preferred. Two or more trinuclear cores may be bonded to one or more ligands or interconnected by one or more ligands, and the ligands may be polyvalent (i.e., have multiple connections to one or more cores). Oxygen and/or selenium may be substituted for sulfur in the cores.

The oil-soluble trinuclear organic molybdenum compound that is suitable can be prepared by allowing a molybdenum source, such as $(NH_4)_2MO_3S_{13}.n(H_2O)$ (wherein n varies between 0 and 2 and includes non-stoichiometric values), etc., to react with an appropriate ligand source, such as a tetraalkylthiuram disulfide, etc., in an appropriate liquid/solvent. Another oil soluble trinuclear molybdenum compound may be formed by allowing a molybdenum source, such as $(NH_4)_2Mo_3S_{13}.n(H_2O)$, etc.; a ligand source, such as a tetraalkylthiuram disulfide, a dialkyldithiocarbamic acid, etc.; and a sulfur-abstracting agent, such as a cyanide ion, a sulfite ion, etc., to react with each other in an appropriate solvent. Alternatively, an oil-soluble trinuclear molybdenum compound may also be formed by allowing a trinuclear molybdenum-sulfur halide salt, such as $[M']_2[Mo_3S_7A_6]$ (wherein M' is a counter ion, and A is a halogen, such as Cl, Br, I, etc.) to react with a ligand source, such as a dialkyldithiocarbamic acid, etc., in an appropriate liquid/solvent. The appropriate liquid/solvent may be, for example, aqueous or organic.

It is preferred that the selected ligand has a sufficient number of carbon atoms in order to render the aforementioned compound soluble in the lubricating oil composition.

The trinuclear organic molybdenum compound is preferably a trinuclear molybdenum dithiocarbamate.

As for the component (C), the aforementioned compounds may be used singly or may be used in combination of two or more thereof.

The content of the component (C) is 200 to 1,000 ppm by mass on the basis of the whole amount of the lubricating oil composition for internal combustion engine in terms of the molybdenum content derived from the component (C) (in the case of using two or more kinds of the binuclear and/or trinuclear organic molybdenum compound, the total content derived from all of these compounds). In view of the fact that the molybdenum content falls within this range, an excellent friction-reducing effect is obtained. What the excellent friction-reducing effect is revealed is also preferred from the viewpoint of fuel consumption reducing performance. From such a viewpoint, the molybdenum content is preferably 300 to 950 ppm by mass, more preferably 350 to 900 ppm by mass, and still more preferably 400 to 800 ppm by mass.

In general, in the case where it is contemplated to obtain the lubricating oil composition for internal combustion engine with a low sulfuric acid ash content, though it may be considered that the content of the component (C) is made smaller, from the viewpoint of the aforementioned excellent friction-reducing effect or fuel consumption reducing performance, it is preferred to make the aforementioned suitable range as the addition amount. As mentioned above, in the lubricating oil composition for internal combustion engine that is the embodiment of the present invention, by using the component (B) in combination with the component (A), the low sulfuric acid ash content can be realized while maintaining the base number necessary for obtaining good detergency. Thus, as to the component (C), it becomes possible to make the aforementioned suitable range as the addition amount without decreasing it more than necessary.

<(D) Phenol-Based Antioxidant>

The lubricating oil composition for internal combustion engine that is the embodiment of the present invention contains (D) a phenol-based antioxidant (hereinafter also referred to simply as "component (D)") in an amount of 0.40 mass % or more on the basis of the whole amount of the lubricating oil composition for internal combustion engine. In view of the fact that the component (D) is contained in an amount of 0.40 mass % or more, a decrease of the base number at the time of contamination of NOx gas can be suppressed, and an excellent friction-reducing effect is brought. From the same viewpoints, the content of the component (D) is preferably 0.45 mass % or more, more preferably 0.49 mass % or more, and still more preferably 0.50 mass % or more.

Although an upper limit value thereof is not particularly limited, it is preferably 3.00 mass % or less, and more preferably 2.00 mass % or less.

Although the component (D) is not particularly limited, examples thereof include 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-methyl-6-tert-butylphenol, 2,6-di-tert-amyl-p-cresole, 2,6-di-tert-butyl-4-(N,N'-dimethylaminomethylphenol), 4,4'-thiobis(2-methyl-6-t-butylphenonol), 4,4'-thiobis(3-methyl-6-tert-butylphenol), 2,2'-thiobis(4-methyl-6-tert-butylphenol), bis (3-methyl-4-hydrxoy-5-tert-butylbenzyl) sulfide, bis(3,5-di-tert-butyl-4-hydroxybenzyl) sulfide, n-octyl-3-(4-hydroxy-3,5-di-tert-butylphenyl) propionate, n-octadecyl-3-(3,5-di-tert-butyl-4-hydroxyphenyl) propionate, 2,2'-thio[diethyl-bis-3-(3,5-di-tert-butyl-4-hydroxyphenyl) propionate], and benzenepropanoic acid, 3,5-bis(1,1-dimethylethyl)-4-hydroxy, C7-9-branched alkyl esters.

Of those, the component (D) is preferably a bisphenol-based or ester group-containing phenol-based compound, more preferably an ester group-containing phenol-based compound, and still more preferably benzenepropanoic acid, 3,5-bis(1,1-dimethylethyl)-4-hydroxy, C7-9-branched alkyl esters. These compounds may be used singly or may be used in combination of two or more thereof.

<(E) Amine-Based Antioxidant>

The lubricating oil composition for internal combustion engine that is the embodiment of the present invention contains (E) an amine-based antioxidant (hereinafter also referred to simply as "component (E)") in an amount of 0.60 mass % or more on the basis of the whole amount of the lubricating oil composition for internal combustion engine. In view of the fact that the component (E) is contained in an amount of 0.60 mass % or more, a decrease of the base number at the time of contamination of NOx gas can be suppressed, and an excellent friction-reducing effect is brought. From the same viewpoints, the content of the component (E) is preferably 0.70 mass % or more, more preferably 0.80 mass % or more, still more preferably 0.90 mass % or more, and yet still more preferably 1.00 mass % or more.

Although an upper limit value thereof is not particularly limited, it is preferably 3.00 mass % or less, and more preferably 2.00 mass % or less.

Although the component (E) is not particularly limited, examples thereof include diphenylamine-based compounds, such as diphenylamine, a monoalkyl diphenylamine having an alkyl group having 3 to 20 carbon atoms, a dialkyl diphenylamine having an alkyl group having 3 to 20 carbon atoms, etc.; and naphthylamine-based compounds, such as α-naphthylamine, a phenyl-α-naphthylamine substituted with an alkyl group having 3 to 20 carbon atoms. Specifically, examples thereof include monoalkyl diphenylamine-based compounds, such as monooctyl diphenylamine, monononyl diphenylamine, etc.; dialkyl diphenylamine-based compounds, such as dibutyl diphenylamine, dipentyl diphenylamine, dihexyl diphenylamine, diheptyl diphenylamine, dioctyl diphenylamine, dinonyl diphenylamine, etc.; polyalkyl diphenylamine-based compounds, such as tetrabutyl diphenylamine, tetrahexyl diphenylamine, tetraoctyl diphenylamine, tetranonyl diphenylamine, etc.; alkyl-substituted phenyl-α-naphthylamines, such as α-naphthylamine, phenyl-α-naphthylamine, butylphenyl-α-naphthylamine, pentylphenyl-α-naphthylamine, hexylphenyl-α-naphthylamine, heptylphenyl-α-naphthylamine, octylphenyl-α-naphthylamine, nonylphenyl-α-naphthylamine, etc.; and the like.

Of those, dialkyl diphenylamine-based or naphthylamine-based compounds are preferred, dialkyl diphenylamine-based compounds are more preferred, and 4,4'-dinonyl diphenylamine is still more preferred. These compounds may be used singly or may be used in combination of two or more thereof.

In view of the fact that the component (D) and the component (E) are used in combination, the component (D) effectively acts mainly on the initial stage of oxidation, and when used in combination with the component (E), it becomes possible to keep the oxidation stability and friction-reducing effect over a longer period of time due to a synergistic effect as compared with the case of using these components individually.

<Other Components>

The lubricating oil composition for internal combustion engine that is the embodiment of the present invention may be further blended with other components than the aforementioned components (A) to (E) within a range of not impeding the effects of the present invention. Examples of other components include additives which are usually used for lubricating oils, such as a viscosity index improver, a friction modifier other than the component (C) and having also a function as an antioxidant, e.g., a zinc organodithiophosphate, etc., an antioxidant other than the components (D) and (E), an ashless dispersant, an ashless friction modifier, an extreme pressure agent, a rust preventive, a pour-point depressant, a metal deactivator, an antifoaming agent, etc., and nonmetallic additives are more preferably exemplified.

Examples of the viscosity index improver include a non-dispersion type polyalkyl (meth)acrylate, a dispersion type polyalkyl (meth)acrylate, an olefin-based copolymer (for example, an ethylene-propylene copolymer, etc.), a dispersion type olefin-based copolymer, a styrene-based copolymer (for example, a styrene-diene copolymer, a styrene-isoprene copolymer, etc.), and the like.

As the viscosity index improver, a polymer having a structure having a large number of trigeminal branch points from which a linear side chain comes out (the polymer will be hereinafter referred to as "comb-shaped polymer") on a main chain. As such a comb-shaped polymer, there are preferably exemplified polymers having at least a constituent unit derived from a macromonomer having a polymerizable functional group, such as a (meth)acryloyl group, an ethenyl group, a vinyl ether group, an allyl group, etc. Here, the foregoing constituent unit is corresponding to the "linear side chain".

More specifically, copolymers having a side chain including a constituent unit derived from a macromonomer having the aforementioned polymerizable functional group on a main chain including a constituent unit derived from a vinyl monomer of every kind, such as an alkyl (meth)acrylate, a nitrogen atom-containing monomer, a halogen element-containing monomer, a hydroxyl group-containing monomer, an aliphatic hydrocarbon-based monomer, an alicyclic hydrocarbon-based monomer, an aromatic hydrocarbon-based monomer, etc., are preferably exemplified.

A number average molecular weight (Mn) of the macromonomer is preferably 200 or more, more preferably 300 or more, and still more preferably 400 or more, and preferably 100,000 or less, more preferably 50,000 or less, and still more preferably 10,000 or less.

From the viewpoint of improving the fuel consumption reducing properties, a weight average molecular weight (Mw) of the comb-shaped polymer is preferably 1,000 to 1,000,000, more preferably 5,000 to 800,000, and still more preferably 50,000 to 700,000. A molecular weight distribution (Mw/Mn) is preferably 6 or less, more preferably 5.6 or less, and still more preferably 5 or less; and though a lower limit value thereof is not particularly limited, it is typically 1.01 or more, preferably 1.05 or more, more preferably 1.10 or more, and still more preferably 1.50 or more.

In the case if containing the comb-shaped polymer, from the viewpoint of improving the fuel consumption reducing properties, the content of the comb-shaped polymer is preferably 0.10 to 20.00 mass %, more preferably 0.50 to 10.00 mass %, and still more preferably 1.00 to 8.00 mass % on the basis of the whole amount of the lubricating oil composition. Here, the content of the comb-shaped polymer means the content of only the resin component composed of the comb-shaped polymer and is, for example, the content on the basis of the solid component, in which the mass of a diluent oil and so on contained together with the comb-shaped polymer is not included.

The viscosity index improver is preferably a polyalkyl (meth)acrylate having an SSI of 30 or less. Here, the SSI means a shear stability index and expresses ability to resist the decomposition of the polymer (polyalkyl (meth)acrylate). As the SSI is larger, the polymer is instable against shearing and is more likely decomposed. The SSI expresses a percentage of viscosity decrease to be caused due to shearing originated from the polymer and is calculated according to the following calculation formula.

$$SSI = \frac{Kv_0 - Kv_1}{Kv_0 - Kv_{oil}} \times 100 \quad \text{[Math. 1]}$$

In the formula, $Kv_0$ represents a value of kinematic viscosity at 100° C. of a mixture of the base oil having the polyalkyl (meth)acrylate added thereto. $Kv_1$ represents a value of kinematic viscosity at 100° C. measured after passing the mixture of the base oil having the polyalkyl (meth)acrylate added thereto through a high-shear Bosch diesel injector for 30 cycles according to the procedures of ASTM D6278. $Kv_{oil}$ denotes a value of kinematic viscosity at 100° C. of the base oil. As the base oil, a base oil belonging to Group II and having a kinematic viscosity at 100° C. of 5.35 $mm^2/s$ and a viscosity index of 105 is used.

By using the polyalkyl (meth)acrylate having an SSI of 30 or less, wear prevention properties of the lubricating oil composition can be enhanced. The SSI is more preferably 1 to 25. By regulating the SSI to 25 or less, the wear prevention properties of the lubricating oil composition can be more enhanced.

The monomer that constitutes the aforementioned polyalkyl (meth)acrylate is an alkyl (meth)acrylate, and preferably an alkyl (meth)acrylate of a linear alkyl group having 1 to 18 carbon atoms or a branched alkyl group having 3 to 34 carbon atoms.

A weight average molecular weight (Mw) of the polyalkyl (meth)acrylate as converted into polystyrene is preferably 10,000 to 1,000,000, and more preferably 30,000 to 500,000. By allowing the weight average molecular weight of the polyalkyl (meth)acrylate to fall within this range, it becomes easy to regulate the value of SSI to 30 or less. The weight average molecular weight (Mw) is measured by the method described in the Examples as mentioned later.

These viscosity index improvers may be used singly or may be used in combination with two or more thereof.

The content of the viscosity index improver is preferably 0.10 to 20.00 mass %, more preferably 1.00 to 15.00 mass %, and still more preferably 2.00 to 10.00 mass % on the basis of the whole amount of the lubricating oil composition. By allowing the content to fall within this range, it becomes easy to regulate the viscosity of the lubricating oil composition to the desired value.

Although the zinc organodithiophosphate is not particularly limited, examples thereof include a compound represented by the following general formula (III).

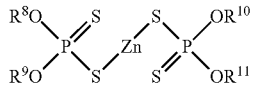

(III)

wherein in the general formula (III), each of $R^8$, $R^9$, $R^{10}$, and $R^{11}$ independently represents a hydrocarbyl group having 1 to 24 carbon atoms.

The hydrocarbyl group having 1 to 24 carbon atoms is any of a linear or branched alkyl group having 1 to 24 carbon atoms, a linear or branched alkenyl group having 3 to 24 carbon atoms, a cycloalkyl group or a linear or branched alkylcycloalkyl group each having 5 to 13 carbon atoms, an aryl group or a linear or branched alkylaryl group each having 6 to 18 carbon atoms, and an arylalkyl group having 7 to 19 carbon atoms. Of those, an alkyl group is preferred, and a primary or secondary alkyl group having 3 to 22 carbon atoms is more preferred.

The zinc organodithiophosphate is preferably a zinc dialkyldithiophosphate, and more preferably zinc secondary dialkyldithiophosphate. These compounds may be used singly or may be used in combination of two or more thereof.

The content of the zinc organodithiophosphate is preferably 0.05 to 20.00 mass %, more preferably 0.10 to 15.00 mass %, still more preferably 0.50 to 10.00 mass %, and yet still more preferably 0.80 to 5.00 mass % on the basis of the whole amount of the lubricating oil composition.

The zinc organodithiophosphate also has a function as an antioxidant. Since a part of the mechanism of action for which the zinc organodithiophosphate prevents the oxidation is a mechanism of action different from the components (D) and (E), it is preferred that the zinc organodithiophosphate is used jointly together with the components (D) and (E). Specifically, though the components (D) and (E) are a chain termination type antioxidant, the zinc organodithiophosphate also has an action to prevent oxidation mainly due to decomposition of a peroxide while having the chain termination type action. Although the chain termination type antioxidant suppresses the formation of a hydroperoxide, it does not bring an effect against the formed hydroperoxide. Thus, by using the zinc organodithiophosphate in combination with the components (D) and (E), a synergistic effect is obtained, and a more excellent antioxidation performance can be brought.

Examples of the antioxidant other than the components (D) and (E) include a sulfur-based antioxidant, such as dilauryl-3,3'-thiodipropionate, etc.; a phosphorus-based antioxidant, such as a phosphite, etc.; and the like. As such an antioxidant, an arbitrary compound can be properly selected and used among known antioxidants which have been conventionally used as an antioxidant of lubricating oil. These compounds may be used singly or may be used in combination of two or more thereof.

Examples of the ashless dispersant include a polybutenyl succinimide (e.g., polybutenyl succinic monoimide, polybutenyl succinic bisimide, etc.), polybutenylbenzylamine, and polybutenylamine, each of which has a polybutenyl group having a number average molecular weight (Mn) of 900 to 3,500, and a derivative thereof, such as a boric acid-modified product thereof (e.g., borated polybutenyl succinic monoimide, etc.), etc., and the like. These ashless dispersants may be used singly or may be used in combination of two or more thereof.

The content of the ashless dispersant is preferably 0.10 to 15.00 mass %, more preferably 1.00 to 10.00 mass %, and still more preferably 2.00 to 10.00 mass % on the basis of the whole amount of the lubricating oil composition.

As the ashless friction modifier, an ester-based friction modifier, such as a partial ester compound obtained through, for example, a fatty acid with an aliphatic polyhydric alcohol, etc., is used. The fatty acid is preferably a fatty acid having a linear or branched hydrocarbon group having 6 to 30 carbon atoms, and the number of carbon atoms of the hydrocarbon group is more preferably 8 to 24, and especially preferably 10 to 20. The aliphatic polyhydric alcohol is a dihydric to hexahydric alcohol, and examples thereof include ethylene glycol, glycerin, trimethylolpropane, pentaerythritol, sorbitol, and the like.

These compounds may be used singly or may be used in combination of two or more thereof.

Examples of the extreme pressure agent include sulfur-based compounds, such as an olefin sulfide, a dialkyl polysulfide, a diarylalkyl polysulfide, a diaryl polysulfide, etc.; phosphorus-based compounds, such as a phosphoric acid ester, a thiophosphoric acid ester, a phosphorus acid ester, an alkyl hydrogen phosphite, a phosphoric acid ester amine salt, a phosphorous acid ester amine salt, etc.; and the like. These compounds may be used singly or may be used in combination of two or more thereof.

As the rust preventive, for example, alkyl or alkenyl succinic acid derivatives, such as dodecenyl succinic acid half ester, octadecenyl succinic anhydride, dodecenyl succinic acid amide, etc.; polyhydric alcohol partial esters, such as sorbitan monooleate, glycerin monooleate, pentaerythritol monooleate, etc.; amines, such as rosin amine, N-oleyl sarcosine, etc.; dialkyl phosphite amine salts; and the like can be used. These compounds may be used singly or may be used in combination of two or more thereof.

Examples of the metal deactivator include benzotriazole, a triazole derivative, a benzotriazole derivative, and a thiadiazole derivative.

Examples of the pour-point depressant include an ethylene-vinyl acetate copolymer, a condensation product of a chlorinated paraffin and naphthalene, a condensation product of a chlorinated paraffin and phenol, a polymethacrylate, a polyalkylstyrene, and the like. In particular, a polymethacrylate is preferably used.

Examples of the antifoaming agent include a dimethylpolysiloxane, a polyacrylate, and the like.

[Production Method of Lubricating Oil Composition for Internal Combustion Engine]

The production method of a lubricating oil composition for internal combustion engine as an embodiment of the present invention is concerned with a method for producing a lubricating oil composition for internal combustion engine, including blending a lubricating base oil composed of a mineral oil and/or a synthetic oil, (A) an overbased calcium salicylate, (B) an overbased magnesium detergent having a median diameter of 100 nm or more as measured by photon correlation spectroscopy, (C) a binuclear and/or trinuclear organic molybdenum compound, (D) a phenol-based antioxidant, and (E) an amine-based antioxidant such that the molybdenum content derived from the component (C) is 200 to 1,000 ppm by mass on the basis of the whole amount of the lubricating oil composition; the content of the component (D) is 0.40 mass % or more on the basis of the whole amount of the lubricating oil composition; and the content of the component (E) is 0.60 mass % or more on the basis of the whole amount of the lubricating oil composition.

In the production method of a lubricating oil composition for internal combustion engine that is the embodiment of the present invention, other components than the components (A) to (E) may be further blended.

The lubricating base oil, the aforementioned components (A) to (E), and other components are the same as those described above, and the lubricating oil composition for internal combustion engine obtained by the production method of the present invention is described previously. Thus, their descriptions are omitted.

In the present production method, the aforementioned components (A) to (E) and other components may be blended in the lubricating base oil by any method, and a method thereof is not limited.

As the lubrication method of using a lubricating oil composition for internal combustion engine as an embodiment of the present invention, there is, for example, exemplified a method including charging the lubricating oil composition for internal combustion engine that is an embodiment of the present invention in an internal combustion engine, such as an engine, etc., to lubricate a gap between respective parts according to the internal combustion engine. The lubricating oil composition for internal combustion engine that is the embodiment of the present invention is more preferably used as a lubricating oil for lubricating a gap between respective parts in an internal combustion engine in which a post-processing device of exhaust gas as mentioned later is installed therein, a gap between respective parts in a diesel engine, or the like.

[Application of Lubricating Oil Composition for Internal Combustion Engine]

The lubricating oil composition for internal combustion engine that is the embodiment of the present invention can be preferably used as an lubricating oil for internal combustion engine, such as a gasoline engine, a diesel engine, a gas engine, etc., of an automobile, e.g., a two-wheeled vehicle, a four-wheeled vehicle, etc., a power generator, a ship, etc. In particular, because of a low sulfuric acid ash content, the lubricating oil composition for internal combustion engine that is the embodiment of the present invention is suitable for internal combustion engines (for example, a direct injection gasoline engine, namely a downsizing engine, mounted with a supercharger, such as a turbo charger, etc.) and diesel engines having a post-processing device of exhaust gas (in particular, a particulate filter or an exhaust gas cleaning device) installed therein. In addition, the lubricating oil composition for internal combustion engine that is the embodiment of the present invention is a lubricating oil composition for internal combustion engine capable of sufficiently coping with the exhaust gas regulation in the future.

The lubricating oil composition for internal combustion engine that is the embodiment of the present invention is suitably used for charging in such an internal combustion engine, particularly an internal combustion engine or a diesel engine having a post-processing device of exhaust gas installed therein, to lubricate a gap between respective parts according to such an internal combustion engine.

EXAMPLES

The present invention is described in more detail by reference to Examples, but it should be construed that the present invention is by no means limited by these Examples.

In the present specification, various physical properties of respective raw materials used in the Examples and Comparative Examples were determined according to the following procedures.

(1) Kinematic Viscosity

The kinematic viscosity is a value measured using a glass capillary viscometer in conformity with JIS K2283-2000.

(2) Viscosity Index

The viscosity index is a value measured in conformity with JIS K2283.

(3) NOACK Value

The NOACK value is a value measured in conformity with the method prescribed in ASTM D5800 (at 250° C. for one hour).

(4) Ring Analysis (% $C_A$ and % $C_p$)

A proportion (percentage) of aromatic components and a proportion (percentage) of paraffin components as calculated by the ring analysis n-d-M method are expressed as % $C_A$ and % $C_p$, respectively. These are those measured in conformity with ASTM D-3238.

(5) Base Number

The base number is one measured by the perchloric acid method in conformity with JIS K2501.

(6) Weight Average Molecular Weight (Mw) of Poly(Meth) Acrylate

The weight average molecular weight (Mw) is a value measured under the following conditions and obtained using polystyrene as a calibration curve. The details are those as measured under the following conditions.

Apparatus: "GPC-900" (a product name, manufactured by JASCO Corporation)

Column: Two "TSK gel GMH6" columns (a product name, manufactured by Tosoh Corporation)

Solvent: THF

Temperature: 40° C.

Sample concentration: 0.5 mass %

Calibration curve: Polystyrene

Detector: Differential refractometer detector (7) Dispersed Particle Diameter and Dispersed Particle Diameter Distribution of Magnesium Detergent A magnesium detergent was dispersed in a hydrorefined base oil, "Yubase 3" (a trade name; "Yubase" is a registered trademark, manufactured by SK Lubricants) to regulate the magnesium concentration to 1,200 ppm by mass relative to the whole amount of the magnesium detergent and the base oil, thereby preparing a measurement sample. The measurement sample was measured at 25° C. using a particle diameter measurement system, "ELSZ-1000S" (a trade name, manufactured by Otsuka Electronics Co., Ltd.) by the dynamic light scattering method (photon correlation spectroscopy). The dispersed particle diameter distribution was analyzed by the CONTIN method, and a median diameter (D(50)) and a 90% particle diameter (D(90)) on the basis of scattering intensity were calculated.

The obtained results are shown in the following Table 1.

The methods for evaluating the lubricating oil composition in each of the Examples and Comparative Example are as follows.

[Metal Content]

The calcium (Ca) content, the magnesium (Mg) content, the phosphorus (P) content, and the molybdenum (Mo) content were measured in conformity with JPI-5S-38-03.

[Sulfuric Acid Ash Content]

The sulfuric acid ash content was measured in conformity with JIS K2272.

[Mixing Stability]

The appearance of each of lubricating oils obtained by mixing the respective raw materials described in Tables 2 and 3 was confirmed through visual inspection and evaluated according to the following criteria.

Good: After mixing the respective raw materials, no precipitate was confirmed.

Precipitated: Immediately after mixing the respective raw materials, precipitation was generated.

[NOx Gas Injection Test]

<Preparation of NOx-Degraded Oil>

A mixture of air at a flow rate of 100 mL/min and nitrogen monoxide (NO) diluted with nitrogen (NO concentration: 8,000 ppm by volume) at a flow rate of 100 mL/min was introduced into 100 g of a sample at an oil temperature of 140° C., and a NOx-degraded oil was prepared taking 72 hours.

<Evaluation of Base Number of NOx-Degraded Oil>

With respect to the aforementioned NOx-degraded oil, a base number by the hydrochloric acid method was measured in conformity with JIS K2501.

The case where the base number by the hydrochloric acid method is more than 0.75 mgKOH/g was evaluated such that a decrease of the base number at the time of contamination of NOx gas is suppressed.

<Evaluation of Caulking Resistance>

As an indicator of the caulking resistance, merit ratings of a hot tube test were measured according to the following procedures.

An oil for hot tube test of the aforementioned NOx-degraded oil having 1 mass % of 1-ethyl-4-nitrobenzene mixed therewith was prepared.

The hot tube test was performed under the conditions in conformity with JPI-5S-55-99, except for setting a test temperature to 240° C. After lapsing 16 hours, the attachment state of a deposit in the interior of the glass tube was evaluated at 0.5 increments between Score 0 (colored black) and Score 10 (colorless: no deposit), and the evaluation was made by 21 ratings (merit ratings).

The case where the merit rating is 5.0 or more was evaluated such that the caulking resistance is excellent.

TABLE 1

| | Dispersed particle diameter | | Dispersed particle diameter distribution | | | | |
|---|---|---|---|---|---|---|---|
| | Median diameter D(50) [nm] | 90% particle diameter D(90) [nm] | Less than 100 nm [%] | 200 nm or more [%] | 300 nm or more [%] | 400 nm or more [%] | 500 nm or more [%] |
| Magnesium detergent (1) | 191.2 | 383.4 | 12.0 | 46.9 | 21.2 | 8.5 | 2.9 |
| Magnesium detergent (2) | 252.2 | 592.4 | 42.7 | 55.4 | 43.5 | 29.3 | 17.7 |
| Magnesium detergent (3) | 175.0 | 460.9 | 44.0 | 44.5 | 26.5 | 14.8 | 7.5 |
| Magnesium detergent (4) | 76.0 | 93.1 | 96.7 | 0.0 | 0.0 | 0.0 | 0.0 |
| Magnesium detergent (5) | 72.0 | 129.9 | 75.5 | 0.4 | 0.0 | 0.0 | 0.0 |

[Friction-Reducing Effect]

Using a high frequency friction machine, "TE77" (manufactured by Phoenix Tribology Ltd.) and using a test plate (material: FC250, shape: 58 mm in length×20 mm in width×4 mm in thickness) and a test cylinder pin (material: SUJ-2, shape: 6 mm in diameter×14 mm in length), a running-in operation was performed for 60 minutes under the conditions of an amplitude of 8 mm, a frequency of 20 Hz, an oil temperature of 80° C., and a load range of 10 to 200 N.

Thereafter, a coefficient of friction was measured under the conditions of an amplitude of 8 mm, a frequency of 20 Hz, an oil temperature of 80° C., and a load of 80 N, thereby evaluating the friction-reducing effect.

Examples 1 to 9 and Comparative Examples 1 to 8

Lubricating oil compositions were prepared in blending compositions shown in the following Tables 2 and 3. Thereafter, the lubricating oil composition of each of the Examples and Comparative Examples was evaluated. The obtained results are shown in the following Tables 2 and 3.

TABLE 2

| | | | Unit | Example 1 | Example 2 | Example 3 | Example 4 | Example 5 |
|---|---|---|---|---|---|---|---|---|
| Blending composition (mass %) | Lubricating base oil | | — | Balance | Balance | Balance | Balance | Balance |
| | Component (A) | Overbased calcium salicylate (1) | mass % | 1.00 | 1.00 | — | — | 1.00 |
| | | Overbased calcium salicylate (2) | mass % | — | — | 1.55 | — | — |
| | | Overbased calcium salicylate (3) | mass % | — | — | — | 2.00 | — |
| | Component (B) | Magnesium detergent (1) | mass % | 0.73 | 0.73 | 0.73 | 0.73 | — |
| | | Magnesium detergent (2) | mass % | — | — | — | — | 0.55 |
| | | Magnesium detergent (3) | mass % | — | — | — | — | — |
| | | Magnesium detergent (4) | mass % | — | — | — | — | — |
| | | Magnesium detergent (5) | mass % | — | — | — | — | — |
| | Component (C) | Organic molybdenum compound (1) | mass % | 0.40 | 0.30 | 0.40 | 0.40 | 0.40 |
| | | Organic molybdenum compound (2) | mass % | — | 0.20 | — | — | — |
| | Component (D) | Phenol-based antioxidant | mass % | 0.50 | 0.50 | 0.50 | 0.50 | 0.50 |
| | Component (E) | Amine-based antioxidant | mass % | 1.00 | 1.00 | 1.00 | 1.00 | 1.00 |
| | Other components | Overbased calcium sulfonate | mass % | — | — | — | — | — |
| | | Viscosity index improver | mass % | 5.00 | 5.00 | 5.00 | 5.00 | 5.00 |
| | | Zinc dialkyldithiophosphate | mass % | 1.10 | 1.10 | 1.10 | 1.10 | 1.10 |
| | | Borated polybutenyl succinic monoimide | mass % | 2.00 | 2.00 | 2.00 | 2.00 | 2.00 |
| | | Polybutenyl succinic bisimide | mass % | 3.00 | 3.00 | 3.00 | 3.00 | 3.00 |
| | | Other additives | mass % | 0.50 | 0.50 | 0.50 | 0.50 | 0.50 |
| | Total | | mass % | 100.00 | 100.00 | 100.00 | 100.00 | 100.00 |
| Properties of composition | Metal component | Calcium | ppm by mass | 1,250 | 1,250 | 1240 | 1,220 | 1,250 |
| | | Magnesium | ppm by mass | 504 | 504 | 504 | 504 | 512 |
| | | Phosphorus | ppm by mass | 792 | 792 | 792 | 792 | 792 |
| | | Molybdenum | ppm by mass | 400 | 410 | 400 | 400 | 400 |
| | Sulfuric acid ash content | | mass % | 0.80 | 0.80 | 0.80 | 0.79 | 0.80 |
| Characteristics of composition | Mixing stability | | — | Good | Good | Good | Good | Good |
| | Performance after | Base number (hydrochloric acid method) | mgKOH/g | 1.20 | 1.31 | 1.44 | 1.53 | 0.80 |
| | NO*x* gas injection test | Hot tube merit rating (evaluation of caulking resistance) | Merit rating | 7.5 | 8.0 | 8.0 | 8.0 | 7.5 |
| | Coefficient of friction by TE77 high frequency friction test (evaluation of friction-reducing effect) | | — | 0.028 | 0.029 | 0.027 | 0.027 | 0.036 |

| | | | Unit | Example 6 | Example 7 | Example 8 | Example 9 |
|---|---|---|---|---|---|---|---|
| Blending composition (mass %) | Lubricating base oil | | — | Balance | Balance | Balance | Balance |
| | Component (A) | Overbased calcium salicylate (1) | mass % | — | 1.00 | — | — |
| | | Overbased calcium salicylate (2) | mass % | 1.55 | — | 1.55 | 1.55 |
| | | Overbased calcium salicylate (3) | mass % | — | — | — | — |
| | Component (B) | Magnesium detergent (1) | mass % | — | — | — | — |
| | | Magnesium detergent (2) | mass % | 0.55 | — | — | — |
| | | Magnesium detergent (3) | mass % | — | 0.54 | 0.54 | 0.54 |
| | | Magnesium detergent (4) | mass % | — | — | — | — |
| | | Magnesium detergent (5) | mass % | — | — | — | — |
| | Component (C) | Organic molybdenum compound (1) | mass % | 0.40 | 0.40 | 0.40 | 0.10 |
| | | Organic molybdenum compound (2) | mass % | — | — | — | 0.20 |
| | Component (D) | Phenol-based antioxidant | mass % | 0.50 | 0.50 | 0.50 | 0.50 |
| | Component (E) | Amine-based antioxidant | mass % | 1.00 | 1.00 | 1.00 | 1.00 |
| | Other components | Overbased calcium sulfonate | mass % | — | — | — | — |
| | | Viscosity index improver | mass % | 5.00 | 5.00 | 5.00 | 5.00 |
| | | Zinc dialkyldithiophosphate | mass % | 1.10 | 1.10 | 1.10 | 1.10 |
| | | Borated polybutenyl succinic monoimide | mass % | 2.00 | 2.00 | 2.00 | 2.00 |
| | | Polybutenyl succinic bisimide | mass % | 3.00 | 3.00 | 3.00 | 3.00 |
| | | Other additives | mass % | 0.50 | 0.50 | 0.50 | 0.50 |
| | Total | | mass % | 100.00 | 100.00 | 100.00 | 100.00 |
| Properties of composition | Metal component | Calcium | ppm by mass | 1,240 | 1,250 | 1,240 | 1,240 |
| | | Magnesium | ppm by mass | 512 | 513 | 513 | 513 |

TABLE 2-continued

| | | | | | | | |
|---|---|---|---|---|---|---|---|
| | | Phosphorus | ppm by mass | 792 | 792 | 792 | 792 |
| | | Molybdenum | ppm by mass | 400 | 400 | 400 | 210 |
| | Sulfuric acid ash content | | mass % | 0.80 | 0.80 | 0.80 | 0.79 |
| Characteristics of composition | Mixing stability | | — | Good | Good | Good | Good |
| | Performance after | Base number (hydrochloric acid method) | mgKOH/g | 0.95 | 1.21 | 1.52 | 1.54 |
| | NO*x* gas injection test | Hot tube merit rating (evaluation of caulking resistance) | Merit rating | 8.0 | 7.5 | 8.0 | 8.0 |
| | Coefficient of friction by TE77 high frequency friction test (evaluation of friction-reducing effect) | | — | 0.035 | 0.035 | 0.035 | 0.049 |

TABLE 3

| | | | Unit | Comparative Example 1 | Comparative Example 2 | Comparative Example 3 | Comparative Example 4 |
|---|---|---|---|---|---|---|---|
| Blending composition (mass %) | Lubricating base oil | | — | Balance | Balance | Balance | Balance |
| | Component (A) | Overbased calcium salicylate (1) | mass % | — | — | — | — |
| | | Overbased calcium salicylate (2) | mass % | 1.55 | 1.55 | 1.55 | 1.55 |
| | | Overbased calcium salicylate (3) | mass % | — | — | — | — |
| | Component (B) | Magnesium detergent (1) | mass % | 0.73 | 0.73 | 0.73 | — |
| | | Magnesium detergent (2) | mass % | — | — | — | — |
| | | Magnesium detergent (3) | mass % | — | — | — | 0.54 |
| | | Magnesium detergent (4) | mass % | — | — | — | — |
| | | Magnesium detergent (5) | mass % | — | — | — | — |
| | Component (C) | Organic molybdenum compound (1) | mass % | — | 0.40 | 0.40 | 0.10 |
| | | Organic molybdenum compound (2) | mass % | — | — | — | — |
| | Component (D) | Phenol-based antioxidant | mass % | 0.50 | 0.30 | 0.50 | 0.50 |
| | Component (E) | Amine-based antioxidant | mass % | 1.00 | 1.00 | 0.50 | 1.00 |
| | Other components | Overbased calcium sulfonate | mass % | — | — | — | — |
| | | Viscosity index improver | mass % | 5.00 | 5.00 | 5.00 | 5.00 |
| | | Zinc dialkyldithiophosphate | mass % | 1.10 | 1.10 | 1.10 | 1.10 |
| | | Borated polybutenyl succinic monoimide | mass % | 2.00 | 2.00 | 2.00 | 2.00 |
| | | Polybutenyl succinic bisimide | mass % | 3.00 | 3.00 | 3.00 | 3.00 |
| | | Other additives | mass % | 0.50 | 0.50 | 0.50 | 0.50 |
| | | Total | mass % | 100.00 | 100.00 | 100.00 | 100.00 |
| Properties of composition | Metal component | Calcium | ppm by mass | 1,240 | 1,240 | 1,240 | 1,240 |
| | | Magnesium | ppm by mass | 504 | 504 | 504 | 513 |
| | | Phosphorus | ppm by mass | 792 | 792 | 792 | 792 |
| | | Molybdenum | ppm by mass | 0 | 400 | 400 | 100 |
| | Sulfuric acid ash content | | mass % | 0.78 | 0.80 | 0.80 | 0.79 |
| Characteristics of composition | Mixing stability | | — | Good | Good | Good | Good |
| | Performance after | Base number (hydrochloric acid method) | mgKOH/g | 1.51 | 0.68 | 0.75 | 1.56 |
| | NO*x* gas injection test | Hot tube merit rating (evaluation of caulking resistance) | Merit rating | 3.0 | 4.0 | 4.5 | 7.5 |
| | Coefficient of friction by TE77 high frequency friction test (evaluation of friction-reducing effect) | | — | 0.105 | 0.028 | 0.028 | 0.098 |

| | | | Unit | Comparative Example 5 | Comparative Example 6 | Comparative Example 7 | Comparative Example 8 |
|---|---|---|---|---|---|---|---|
| Blending composition (mass %) | Lubricating base oil | | — | Balance | Balance | Balance | Balance |
| | Component (A) | Overbased calcium salicylate (1) | mass % | — | — | 1.00 | 1.00 |
| | | Overbased calcium salicylate (2) | mass % | 1.55 | — | — | — |
| | | Overbased calcium salicylate (3) | mass % | — | — | — | — |
| | Component (B) | Magnesium detergent (1) | mass % | — | — | — | — |
| | | Magnesium detergent (2) | mass % | — | — | — | — |
| | | Magnesium detergent (3) | mass % | 0.54 | 0.54 | — | — |
| | | Magnesium detergent (4) | mass % | — | — | 0.53 | — |
| | | Magnesium detergent (5) | mass % | — | — | — | 0.53 |
| | Component (C) | Organic molybdenum compound (1) | mass % | — | 0.40 | — | — |
| | | Organic molybdenum compound (2) | mass % | 0.20 | — | 0.20 | 0.20 |
| | Component (D) | Phenol-based antioxidant | mass % | 0.50 | 0.50 | 0.50 | 0.50 |
| | Component (E) | Amine-based antioxidant | mass % | 1.00 | 1.00 | 1.00 | 1.00 |
| | Other components | Overbased calcium sulfonate | mass % | — | 1.05 | — | — |
| | | Viscosity index improver | mass % | 5.00 | 5.00 | 5.00 | 5.00 |
| | | Zinc dialkyldithiophosphate | mass % | 1.10 | 1.10 | 1.10 | 1.10 |
| | | Borated polybutenyl succinic monoimide | mass % | 2.00 | 2.00 | 2.00 | 2.00 |
| | | Polybutenyl succinic bisimide | mass % | 3.00 | 3.00 | 3.00 | 3.00 |
| | | Other additives | mass % | 0.50 | 0.50 | 0.50 | 0.50 |
| | | Total | mass % | 100.00 | 100.00 | 100.00 | 100.00 |
| Properties of composition | Metal component | Calcium | ppm by mass | 1,240 | 1,260 | 1,250 | 1,250 |
| | | Magnesium | ppm by mass | 513 | 513 | 509 | 514 |

TABLE 3-continued

| | | | | | | | |
|---|---|---|---|---|---|---|---|
| | | Phosphorus | ppm by mass | 792 | 792 | 792 | 792 |
| | | Molybdenum | ppm by mass | 110 | 400 | 110 | 110 |
| | Sulfuric acid ash content | | mass % | 0.79 | 0.80 | n.d.*1 | nd.*1 |
| Characteristics of composition | Mixing stability | | — | Good | Good | Precipitated | Precipitated |
| | Performance after NOx gas injection test | Base number (hydrochloric acid method) | mgKOH/g | 1.48 | 0.32 | n.d.*1 | nd.*1 |
| | | Hot tube merit rating (evaluation of caulking resistance) | Merit rating | 6.5 | 8.0 | n.d.*1 | nd.*1 |
| | Coefficient of friction by TE77 high frequency friction test (evaluation of friction-reducing effect) | | — | 0.102 | 0.042 | n.d.*1 | nd.*1 |

*1Not detected because of generation of precipitation at the time of mixing

The respective components in Tables 2 and 3 are as follows.

<Lubricating Base Oil>

Base oil: Hydrorefined base oil, kinematic viscosity at 40° C. is 18.5 $mm^2/s$, kinematic viscosity at 100° C. is 4.15 $mm^2/s$, viscosity index is 133, sulfur content of less than 5 ppm by mass, NOACK value is 13.8 mass %, n-d-M ring analysis of % $C_A$ is 0.1 or less, n-d-M ring analysis of % $C_p$ is 89.5

<Overbased Calcium Salicylate: Component (A)>

Overbased calcium salicylate (1): Base number (perchloric acid method) is 350 mgKOH/g, calcium content is 12.5 mass %, sulfur content is 0.14 mass %, the alkyl group structure of the soap group being a linear alkyl group (main number of carbon atoms of the alkyl group which the component (A) has is 16)

Overbased calcium salicylate (2): Base number (perchloric acid method) is 225 mgKOH/g, calcium content is 8.0 mass %, sulfur content is 0.15 mass %, the alkyl group structure of the soap group being a linear alkyl group (main number of carbon atoms of the alkyl group which the component (A) has is 16)

Overbased calcium salicylate (3): Base number (perchloric acid method) is 170 mgKOH/g, calcium content is 6.1 mass %, sulfur content is 0.25 mass %, the alkyl group structure of the soap group being a linear alkyl group (main number of carbon atoms of the alkyl group which the component (A) has is 22)

<Magnesium Detergent: Component (B)>

Magnesium detergent (1): Overbased magnesium salicylate, base number (perchloric acid method) is 320 mgKOH/g, magnesium content is 6.9 mass %, sulfur content is 0.18 mass %, the alkyl group structure of the soap group being a linear alkyl group (main number of carbon atoms of the alkyl group which the component (B) has is 22), median diameter D(50) is 191.2 nm, 90% particle diameter D(90) is 383.4 nm Magnesium detergent (2): Overbased magnesium sulfonate, base number (perchloric acid method) is 412 mgKOH/g, magnesium content is 9.3 mass %, sulfur content is 1.75 mass %, the alkyl group structure of the soap group being a branched alkyl group (main number of carbon atoms of the alkyl group which the component (B) has is 11), median diameter D(50) is 252.2 nm, 90% particle diameter D(90) is 592.4 nm Magnesium detergent (3): Overbased magnesium sulfonate, base number (perchloric acid method) is 397 mgKOH/g, magnesium content is 9.5 mass %, sulfur content is 2.5 mass %, the alkyl group structure of the soap group being a linear alkyl group (main number of carbon atoms of the alkyl group which the component (B) has is 23), median diameter D(50) is 175.0 nm, 90% particle diameter D(90) is 460.9 nm Magnesium detergent (4): Overbased magnesium sulfonate, base number (perchloric acid method) is 412 mgKOH/g, magnesium content is 9.6 mass %, sulfur content is 1.6 mass %, the alkyl group structure of the soap group being a linear alkyl group (main number of carbon atoms of the alkyl group which the component (B) has is 20), median diameter D(50) is 76.0 nm, 90% particle diameter D(90) is 93.1 nm Magnesium detergent (5): Overbased magnesium sulfonate, base number (perchloric acid method) is 400 mgKOH/g, magnesium content is 9.7 mass %, sulfur content is 1.5 mass %, the soap group being petroleum sulfonate, median diameter D(50) is 72.0 nm, 90% particle diameter D(90) is 129.9 nm <Organic Molybdenum Compound: Component (C)>

Organic molybdenum compound (1): "SAKURA-LUBE (a registered trademark) 515" (a trade name, manufactured by Adeka Corporation), a binuclear molybdenum dithiocarbamate represented by the general formula (I), wherein each of $R^1$ to $R^4$ has the number of carbon atoms of 8 or 13, and each of $X^1$ to $X^4$ is an oxygen atom, molybdenum content is 10.0 mass %, sulfur content is 11.5 mass %

Organic molybdenum compound (2): "INFINEUM C9455B" (a trade name, manufactured by Infineum International Ltd.), a trinuclear molybdenum dithiocarbamate represented by the general formula (II), molybdenum content is 5.5 mass %, sulfur content is 9.9 mass %

<Phenol-Based Antioxidant: Component (D)>

Benzenepropanoic acid, 3,5-bis(1,1-dimethylethyl)-4-hydroxy, C7-9-branched alkyl esters [a trade name, "IRGANOX (a registered trademark) L135", manufactured by BASF SE]

<Amine-Based Antioxidant: Component (E)>

4,4'-Dinonyl diphenylamine, nitrogen content is 3.5 mass %

<Others>

Overbased calcium sulfonate: Base number (perchloric acid method) is 305 mgKOH/g, calcium content: 12.0 mass %, sulfur content is 1.7 mass %, the alkyl group structure of the soap group being a linear alkyl group (main number of carbon atoms of the alkyl group is 16)

Viscosity index improver: Polyalkyl (meth)acrylate, weight average molecular weight (Mw) is 380,000, SSI=20

Zinc dialkyldithiophosphate: Zinc content is 7.85 mass %, phosphorus content is 7.2 mass %, sulfur content is 14.4 mass %, alkyl group; a mixture of secondary propyl group and secondary hexyl group Borated polybutenyl succinic monoimide: Number average molecular weight (Mn) of polybutenyl group is 1,000, nitrogen content is 1.23 mass %, boron content is 1.30 mass %, chlorine content is 0.06 mass %

Polybutenyl succinic bisimide: Number average molecular weight (Mn) of polybutenyl group is 1,300, nitrogen content is 0.99 mass %, chlorine content is 0.01 mass % or less Other additives: Metal deactivator, pour-point depressant, and defoaming agent As is clear from the results of the aforementioned Tables 2 and 3, it could be confirmed that the lubricating oil compositions for internal combustion engine of Examples 1 to 9 are good in the mixing stability at the time of blending, excellent in the value of base number and caulking resistance after the NOx gas injection test, and excellent in the friction-reducing effect.

Meanwhile, in Comparative Examples 1, 4, and 5, the molybdenum content derived from the component (C) is less than 200 ppm by mass, and therefore, it was confirmed that a good friction-reducing effect is not obtained.

In addition, in Comparative Example 2, the content of the component (D) is less than 0.40 mass %, and in Comparative Example 3, the content of the component (E) is less than 0.60 mass %, and therefore, it was confirmed that the value of base number and caulking resistance after the NOx gas injection test are poor.

In addition, in Comparative Example 6, the overbased calcium sulfonate is used in place of the component (A), and therefore, it was confirmed that the value of base number after the NOx gas injection test is poor.

Furthermore, in Comparative Examples 7 and 8, the median diameter (D(50)) of the component (B) is less than 100 nm, and it was confirmed that precipitation was generated immediately after blending the component (A) and the component (B), so that the mixing stability is poor.

INDUSTRIAL APPLICABILITY

The lubricating oil composition for internal combustion engine of the present invention has a low sulfuric acid ash content, is capable of suppressing a decrease of the base number at the time of contamination of NOx gas, and has excellent caulking resistance as well as excellent friction-reducing effect of an engine member. For that reason, the lubricating oil composition for internal combustion engine of the present invention is suitable especially as a lubricating oil for downsizing engine having a post-processing device installed therein. In addition, the lubricating oil composition for internal combustion engine of the present invention is a lubricating oil composition for internal combustion engine capable of sufficiently coping with the exhaust gas regulation in the future.

The invention claimed is:

1. A lubricating oil composition for internal combustion engine, comprising a lubricating base oil comprising a mineral oil, a synthetic oil, or both, and:

(A) an overbased calcium salicylate;

(B) an overbased magnesium detergent;

(C) a binuclear organic molybdenum compound, a trinuclear organic molybdenum compound, or both;

(D) an ester group-containing phenol-based antioxidant;

(E) a dialkyldiphenyl amine-based antioxidant; and (F) a zinc organodithiophosphate of formula (III):

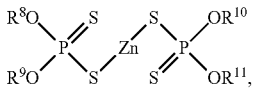

(III)

wherein $R^8$, $R^9$, $R^{10}$, and $R^{11}$ independently represents a hydrocarbyl group having 1 to 24 carbon atoms, wherein:

the component (B) has a median diameter of 100 nm or more as measured by photon correlation spectroscopy;

the component (B) has a 90% particle diameter, D(90), of from 200 nm to 500 nm as measured by photon correlation spectroscopy;

a molybdenum content derived from the component (C) is 200 to 950 ppm by mass on the basis of a total amount of the lubricating oil composition;

a content of the component (D) is 0.40 mass % or more on the basis of the total amount of the lubricating oil composition;

a content of the component (E) is 0.60 mass % or more on the basis of the total amount of the lubricating oil composition;

a content of the component (F) is from 0.8 to 20.00 mass % on the basis of the total amount of the lubricating oil composition; and the lubricating oil composition has a hot tube caulking resistance of from 7.5 to 10.0 after $NO_x$ injection and a coefficient of friction by TE77 high frequency friction test of 0.049 or less.

2. The lubricating oil composition for internal combustion engine according to claim 1, having a sulfuric acid ash content of 1.00 mass % or less on the basis of the total amount of the lubricating oil composition.

3. The lubricating oil composition for internal combustion engine according to claim 1, wherein the overbased magnesium detergent (B) has an alkyl group, and the alkyl group is a linear alkyl group.

4. The lubricating oil composition for internal combustion engine according to claim 1, wherein a base number of the overbased calcium salicylate (A) as measured by the perchloric acid method is 150 mgKOH/g or more.

5. The lubricating oil composition for internal combustion engine according to claim 1, which is adapted to function as a lubricating oil composition for an engine having a post-processing device installed therein.

6. A method for producing a lubricating oil composition which has a hot tube caulking resistance of from 7.5 to 10.0 after $NO_x$ injection and a coefficient of friction by TE77 high frequency friction test of 0.049 or less for internal combustion engine, the method comprising blending a lubricating base oil comprising a mineral oil, a synthetic oil, or both, with:

(A) an overbased calcium salicylate;

(B) an overbased magnesium detergent which has a median diameter of 100 nm or more as measured by photon correlation spectroscopy and a 90% particle diameter, D(90), of from 200 nm to 500 nm as measured by photon correlation spectroscopy;

(C) a binuclear molybdenum compound, a trinuclear organic molybdenum compound, or both;

(D) an ester group-containing phenol-based antioxidant;

(E) a dialkyldiphenyl amine-based antioxidant; and (F) a zinc organodithiophosphate of formula (III):

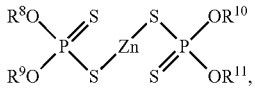

(III)

wherein $R^8$, $R^9$, $R^{10}$, and $R^{11}$ independently represents a hydrocarbyl group having 1 to 24 carbon atoms, such that:

the molybdenum content derived from the component (C) is 200 to 950 ppm by mass on the basis of a total amount of the lubricating oil composition;

a content of the component (D) is 0.40 mass % or more on the basis of the total amount of the lubricating oil composition;

a content of the component (E) is 0.60 mass % or more on the basis of the total amount of the lubricating oil composition and;

a content of the component (F) is from 0.8 to 20.00 mass % on the basis of the total amount of the lubricating oil composition.

7. A lubrication method, comprising lubricating an internal combustion engine with the lubricating oil composition of claim 1.

8. The lubricating oil composition of claim 1, wherein the molybdenum content derived from the component (C) is 200 to 800 ppm by mass on the basis of a total amount of the lubricating oil composition.

9. The method of claim 6, wherein the molybdenum content derived from the component (C) is 200 to 800 ppm by mass on the basis of a total amount of the lubricating oil composition.

10. The lubricating oil composition of claim 1, wherein the molybdenum content derived from the component (C) is 300 to 800 ppm by mass on the basis of a total amount of the lubricating oil composition.

11. The method of claim 6, wherein the molybdenum content derived from the component (C) is 300 to 800 ppm by mass on the basis of a total amount of the lubricating oil composition.

12. The lubricating oil composition of claim 1, wherein a proportion of particles in which a particle diameter occupying 100% of the whole is 500 mm or more in the dispersed particle diameter distribution of the component (B) as measured by photon correlation spectroscopy is 10% or less.

13. The method of claim 6, wherein a proportion of particles in which a particle diameter occupying 100% of the whole is 500 mm or more in the dispersed particle diameter distribution of the component (B) as measured by photon correlation spectroscopy is 10% or less.

14. The lubricating oil composition of claim 1, wherein the content of the component (F) is from 0.8 to 5.00 mass % on the basis of the total amount of the lubricating oil composition.

15. The method of claim 6, wherein the content of the component (F) is from 0.8 to 5.00 mass % on the basis of the total amount of the lubricating oil composition.

16. The lubricating oil composition of claim 1, wherein a calcium content derived from the component (A) is 500 to 2,000 ppm by mass and a magnesium content derived from the component (B) is 200 to 1,000 ppm by mass.

17. The method of claim 6, wherein a calcium content derived from the component (A) is 500 to 2,000 ppm by mass and a magnesium content derived from the component (B) is 200 to 1,000 ppm by mass.

18. The lubricating oil composition of claim 1, wherein a sulfuric acid ash content is 0.90 mass % or less on the basis of a total amount of the lubricating oil composition.

19. The method of claim 6, wherein a sulfuric acid ash content is 0.90 mass % or less on the basis of a total amount of the lubricating oil composition.

20. The lubricating oil composition of claim 1, wherein the overbased calcium salicylate (A) is contained in an amount of 1.00 to 2.00 mass %; the overbased magnesium detergent (B) is present in an amount of 0.54 to 0.73 mass %; and at least one of the binuclear organic molybdenum compound and the trinuclear organic molybdenum compound (C) is present in an amount of from 0.10 to 0.50 mass %.

21. The method of claim 6, wherein the overbased calcium salicylate (A) is contained in an amount of 1.00 to 2.00 mass %; the overbased magnesium detergent (B) is present in an amount of 0.54 to 0.73 mass %; and at least one of the binuclear organic molybdenum compound and the trinuclear organic molybdenum compound (C) is present in an amount of from 0.10 to 0.50 mass %.

* * * * *